United States Patent [19]

Evert

[11] Patent Number: 4,578,042

[45] Date of Patent: Mar. 25, 1986

[54] SAFETY HARNESS PERSONAL FLOTATION DEVICE

[75] Inventor: Karla R. Evert, St. Cloud, Minn.

[73] Assignee: Stearns Manufacturing Company, St. Cloud, Minn.

[21] Appl. No.: 472,091

[22] Filed: Mar. 4, 1983

[51] Int. Cl.[4] ..... B63C 9/08

[52] U.S. Cl. ..... 441/117

[58] Field of Search ..... 441/106, 107, 108, 111–119, 441/11–13, 20; 182/3; 244/151 R, 151 A

[56] References Cited

U.S. PATENT DOCUMENTS

| | | | |
|---|---|---|---|
| 3,475,774 | 11/1969 | Hawkins | 441/118 |
| 3,638,258 | 2/1972 | Black | 441/89 |
| 3,646,626 | 3/1972 | Frieder | 441/115 |
| 3,931,657 | 1/1976 | Jones | 441/116 |
| 4,097,947 | 7/1978 | Kiefer | 441/116 |
| 4,194,257 | 3/1980 | Martin et al. | 441/115 |
| 4,273,216 | 6/1981 | Weissmann | 182/3 |

*Primary Examiner*—Sherman D. Basinger
*Assistant Examiner*—Jesûs D. Sotelo
*Attorney, Agent, or Firm*—Merchant, Gould Smith, Edell Welter & Schmidt

[57] ABSTRACT

A safety harness personal flotation device (10) is disclosed. The device (10) comprises a buoyant body portion (12) having front and back sections (14 and 20, respectively) defining armholes (22*a* and 22*b*) and a neckhole (24). The device (10) further comprises a harness arrangement (40) located on the inside surface (26) of body portion (12). The harness arrangement (40) includes a floating harness (41) which is carried adjacent to the inside surface (26) but is not otherwise significantly attached to the body portion. The flotation device (10) further comprises straps for carrying the floating harness (41) adjacent to the inside surface (26). A ring-like member (72) is provided for attachment to a safety or rescue line. The ring-like member (72) is connected to the harness arrangement (40) and is readily accessible for attachment to a rescue line.

10 Claims, 6 Drawing Figures

FIG. 3
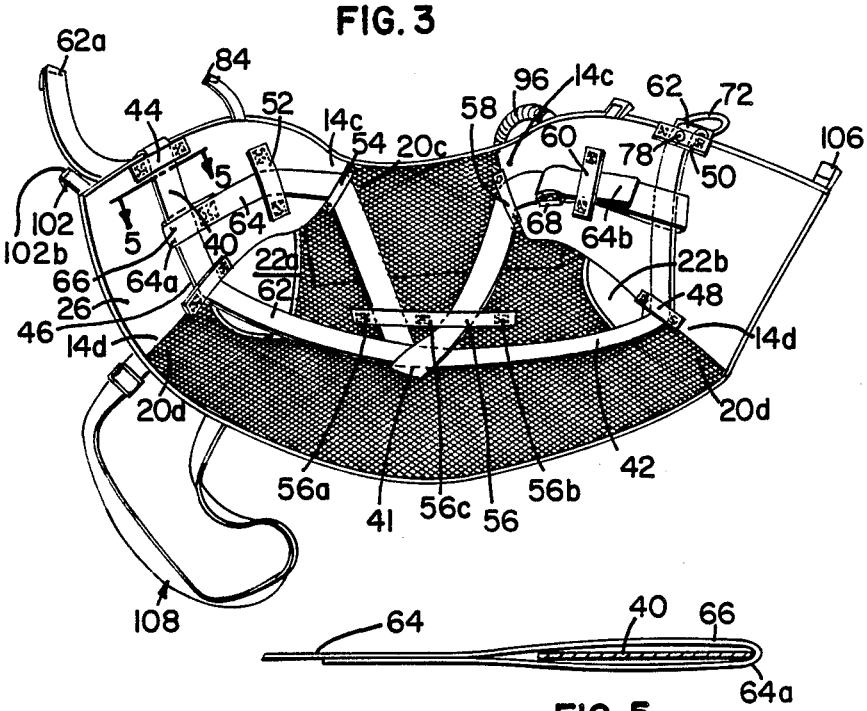
FIG. 5
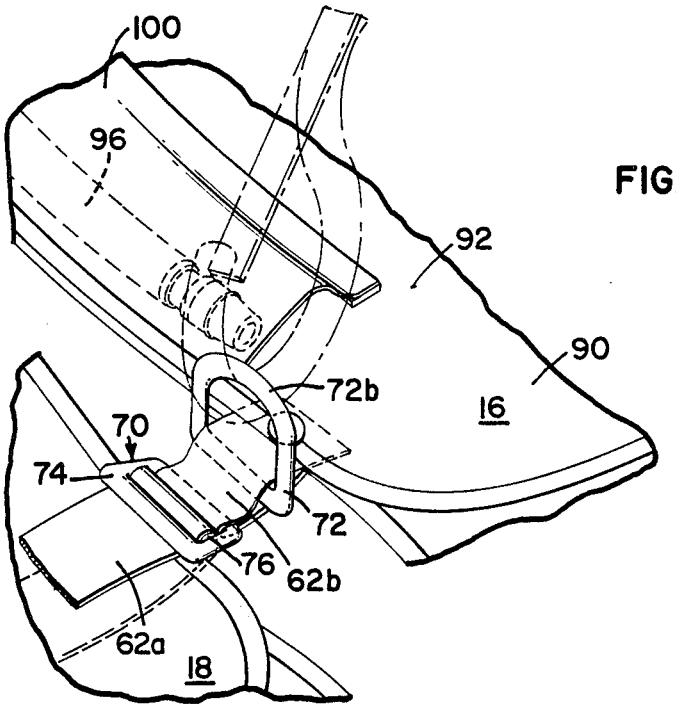
FIG. 4

SAFETY HARNESS PERSONAL FLOTATION DEVICE

TECHNICAL FIELD

The invention of the present application relates generally to the fields of safety harnesses and personal flotation devices. More particularly, this invention relates to a combined safety harness and personal flotation device, where the harness can be used without significant stress or damage to the flotation aspect of the device.

BACKGROUND OF THE INVENTION

Personal flotation devices, particularly those designed as a vest or jacket, are known in the art and have been used for some time. Similarly, safety and rescue harnesses of various types have been used to secure an individual to a line so the individual will be caught if he falls, or to pull an individual into the air, for example, when rescued from the water by a helicopter.

There are times when an individual wearing a personal flotation device requires the use of a rescue line. Where the flotation device does not incorporate a rescue harness, the job of the rescue worker who must use the rescue line can be particularly difficult. He or she must somehow place the harness around the individual in peril, directly over the flotation device. This can be difficult due to the bulkiness of many personal flotation devices and can take considerable time. Moreover, serious damage to the flotation device can result when the individual is lifted from the water. The harness can cut into, tear, deform, or otherwise destroy the integrity of the flotation device.

Alternatively, the rescue worker can first struggle to remove the personal flotation device and then place the harness directly around the victim. Obviously this can be difficult, particularly if the victim is uncooperative. Again, precious time can be lost.

For these and other reasons, attempts have been made to combine both a personal flotation device and a safety or rescue harness. Such a device is desirable whenever an individual might need to be rescued from the water by means of a line. The personal flotation aspects of such a device would allow safety around water and the ease and comfort of a vest, jacket, or other garment-style design. The built-in harness would facilitate the potential rescue operation. However, the combination flotation and harness devices which have been available to date are generally unsatisfactory.

In many cases where a harness is installed in a flotation product, the harness is stitched or otherwise attached to the flotation device in such a way that the flotation device is damaged when a rescue line is attached and the individual is pulled from the water. For example, in many cases the harness is installed on the outer surface of the flotation device. In such a case, serious damage to the device can occur if the harness is ever used. The weight of the individual being pulled by the line creates a tremendous amount of stress on the harness. This stress can cause the harness to cut into, deform or otherwise damage the flotation device, jeopardizing or even destroying its flotation aspects. In addition, rupture, tearing or other damage frequently occurs in the areas where the harness is attached to the device. These areas are particularly strained when the harness must be used.

Even those flotation devices which incorporate a safety harness on the inside surface, rather than on the outside, are generally unsatisfactory. In these devices, the harness is typically attached to the device by stitching, riveting, or other means whereby stress on the harness pulls on the entire product. This can weaken or tear the fabric or seams, impair the flotation aspect or otherwise damage the device, particularly in the areas where the harness is actually attached to the device.

The present invention provides a safety harness and flotation device designed and constructed so that both the harness and flotation aspects can be utilized repeatedly without damage to or a negative effect upon the other. The device has sufficient integrity to easily and repeatedly support the weight of an individual being pulled into the air by a line properly attached to the harness, and generally will not be damaged by such use. It is believed that the device is particularly suitable for use by any person in a potentially dangerous situation where there exists the need or potential need for both a flotation device and a safety or rescue harness. Such users could include off-shore oil workers, ship or shipyard workers, military personnel, and so on, as well as recreational users such as hikers and the like.

SUMMARY OF THE INVENTION

The present invention is a personal flotation device incorporating a safety harness. It is designed to be worn on the body of an individual wearer. The device includes a buoyant body portion comprising a front section and a back section. Both sections have as a general area a top zone and a bottom zone. The top zone is the general area closer to the wearer's neck, upper back, shoulders, and chest. The bottom zone is the area closer to the wearer's waist, lower back and abdomen. The back section and the front section are cooperatively connected one to the other at both the top zones and the bottom zones. At least one of the sections comprises a mass of buoyant material, to provide for flotation. The body portion also includes an inside surface and an outside surface. The inside surface is that surface closest to the wearer.

The device also includes a floating harness carried adjacent to the inside surface, but not otherwise significantly attached to the body portion. Additionally, the device includes means for carrying the floating harness adjacent to the inside surface.

The device further includes a ring-like member or lifting ring connected to the harness arrangement. The ring is readily accessible for attachment to a rescue line.

BRIEF DESCRIPTION OF THE DRAWINGS

FIG. 3 is a front elevational view of the safety harness personal flotation device shown in FIG. 1 as it appears on the inside surface when laid open.

FIG. 4 is an enlarged perspective view of a portion of the safety harness personal flotation device shown in FIG. 1, showing the ring-like member and the adjacent area.

FIG. 5 is a cross-sectional view of the harness arrangement taken along line 5—5 of FIG. 3.

DETAILED DESCRIPTION OF THE INVENTION

Figure 1:
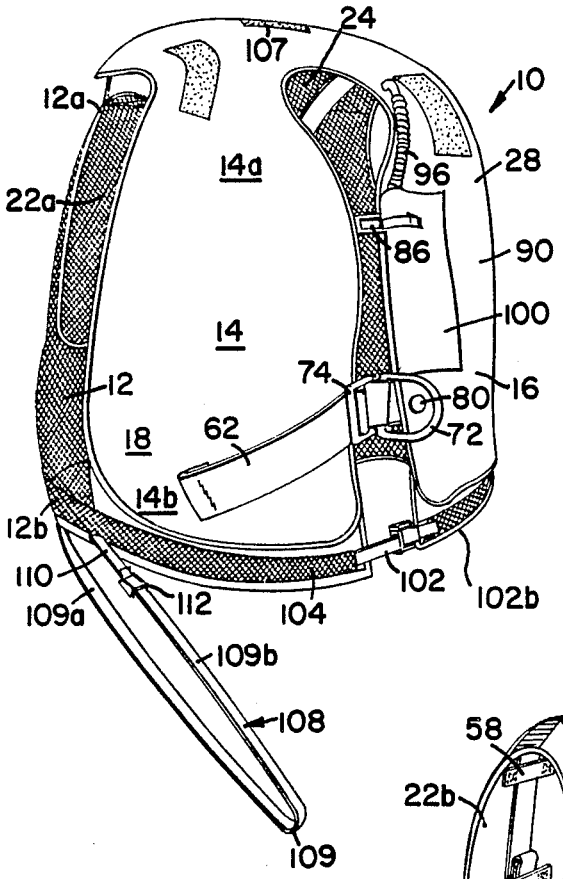
FIG. 1 is a perspective view generally viewed as from above and to the right front of one embodiment of the safety harness personal flotation device incorporating the present invention.
Figure 2:
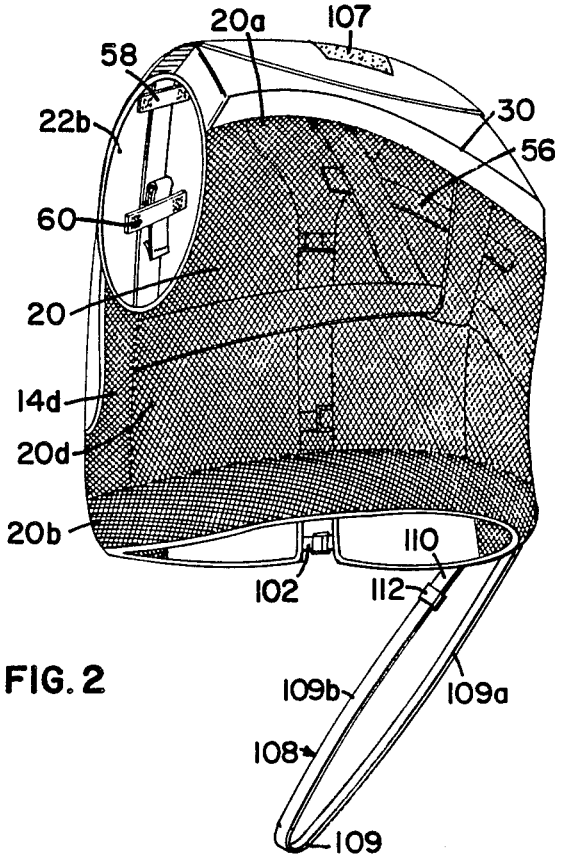
FIG. 2 is a perspective view generally viewed as from below and to the back left of the safety harness personal flotation device shown in FIG. 1.

Referring to the Drawings, wherein like numerals represent like parts throughout the several views, there is generally designated at 10, a safety harness flotation device. The device at 10 is in the nature of a vest to be worn over the torso of an individual wearer, although it is understood that the device could be styled as a jacket having long or short sleeves, a coverall such as is worn by an automobile or airplane mechanic, or any other suitable garment or device which could incorporate the harness and flotation aspects of this invention.

The device 10 comprises buoyant body portion 12 having a top zone 12*a* and a bottom zone 12*b*. The buoyant body portion comprises a front section 14 having a top zone 14*a* and a bottom zone 14*b*, and a back section 20, having a top zone 20*a* and a bottom zone 20*b*.

Front section 14 and back section 20 both have shoulder areas 14*c* and 20*c*, respectively, and side areas 14*d* and 20*d*, respectively. The front and back sections are cooperatively connected one to the other at top zones 14*a* and 20*a*, and at bottom zones 14*b* and 20*b*, by stitching, lacing, riveting, or any other appropriate means. More specifically, front and back sections 14 and 20 are stitched together at shoulder areas 14*c* and 20*c* and side areas 14*d* and 20*d*, defining armholes 22*a* and 22*b*, and neck hole 24. The embodiment as illustrated in the Figures is in the nature of a vest, but it is of course envisioned that other embodiments are possible, such as a jacket-style device having long or short sleeves, or a coverall-type device including leg portions.

The front section 14 will typically comprise a left-front section 16 and a right-front section 18.

Body portion 12 has an inside surface 26, best seen in FIG. 3, and an outside surface 28. Inside surface 12 is the surface closest to the torso of the individual when device 10 is worn.

Device 10 is designed primarily to be worn over clothing, particularly work clothing, and therefore, in a preferred embodiment, back section 20 comprises an open mesh fabric which can permit air circulation and the evaporation of perspiration.

At least one of the back section 20, left-front section 16, and right-front section 18 comprises a mass of buoyant material. In the preferred embodiment, left-front section 16 and right-front section 18 can each comprise a double thickness of fabric, between which can be located a buoyant mass such as closed cell polyvinyl chloride foam. The double thickness of fabric can be stitched, heat-sealed or otherwise appropriately joined around the edges, enclosing the buoyant material. Any other means of incorporating the mass of buoyant material into one of these sections is of course envisioned.

Additionally, in the preferred embodiment, back section 20 comprises a buoyant member 30, attached at top zone 20*a*. Buoyant member 30 can extend across top zone 20*a* from armhole 22*a* to armhole 22*b*. It too can comprise a foamed material such as closed cell polyvinyl chloride foam or other buoyant substance. This material can be enclosed in a fabric casing which is attached by stitching to back section 20. The personal flotation device of this invention provides a positive turning moment, that is, the device will automatically position itself in the water so that the wearer's face is turned upward. Having buoyant material near the top of the back section contributes to the positive turning moment. It is of course envisioned that buoyant means other than or in addition to buoyant member 30 can be used on back section 20 or any other portion of device 10.

Safety harness flotation device 10 also comprises a harness arrangement 40. This harness arrangement is located on the inside surface 26 of buoyant body portion 12 of the vest, jacket, coverall, or other device. Harness arrangement 40 comprises a floating harness 41 which comprises webbing 42. This webbing is located next to inside surface 26, but in the preferred embodiment, in no place is webbing 42 actually attached to the inside surface. The webbing is carried next to the inside surface by means for carrying the floating harness or webbing. The carrying means comprises straps. As shown in FIG. 3, nine straps can be used, 44, 46, 48, 50, 52, 54, 56, 58, 60, each having a first and second end. Each strap is secured or attached at its first and second ends to inside surface 26. Webbing 42 of floating harness 41 is located under the straps, that is, between the straps and inside surface 26. The straps 44–60 are of sufficient length to allow horizontal and vertical movement of the webbing under the straps.

In the preferred embodiment, webbing 42 comprises two separate lengths or portions, portion 62 and portion 64. Portion 62, having a first end 62*a* and a second end 62*b*, passes under straps 44, 46, 48, and 50, and encircles the torso of the wearer, somewhere between the wearer's neck and waist. Typically, portion 62 will pass under the individual's arms and across his chest. First and second ends 62*a* and 62*b* can be connected to each other to releasably secure device 10 to the wearer. Attached to second end 62*b* can be a buckle 70 for engagement with first end 62*a*. Preferably, the buckle comprises an outer ring member 74 to which end 62*b* is attached, and slideably movable bar member 76 positioned inside outer ring member 74. When first and second ends 62*a* and 62*b* are to be releasably and adjustably connected to each other to secure the device to the wearer, end 62*a* is passed inside ring-like member 74 to one side of bar member 76. Bar member 76 is slid toward end 62*a* leaving room on the other side of the bar member for the first end 62*a*. First end 62*a* is looped over the bar member and passed between it and the ring member 74. Webbing portion 62 is then pulled to the desired snugness to secure device 10 to the wearer.

As shown in FIG. 3, webbing portion 64, having a first end 64*a* and a second end 64*b*, passes under straps 52, 54, 56, 58, and 60, in a zig-zag pattern. First end 64*a* is folded back on itself and secured to itself, forming a loop 66. Through this loop passes a portion of harness arrangement 40, specifically webbing portion 62. See FIG. 5. Loop 66 is large enough to allow webbing portion 62 to easily slide through it. Second end 64*b* also loops around webbing portion 62, folding over on itself. However, second end 64*b* engages a buckle 68 which is cooperatively connected to webbing portion 64. With second end 64*b* passing through buckle 68 which releasably holds second end 64*b* in place, the effective length of webbing portion 64 can be adjusted to provide a harness which is comfortable to wear but not so loose on the wearer as to jeopardize rescue efforts. If it is desired that the effective length of portion 64 be shorter, more of portion 64 can be doubled back on itself by pulling a greater length of it back on itself through the buckle. If it is desired that the effective length of webbing portion 64 be greater, less of it can be folded over on itself, with a shorter piece having passed through the buckle. As illustrated in FIG. 3, the length of webbing portion 64 which has been pulled through the buckle can be folded back through strap 60 to hold it in place and keep it out of the way.

Strap 56 will preferably be more than twice as long as two times the width of webbing portion 64. This strap is attached to back section 20, in an approximately central location between armholes 22*a* and 22*b*, and substantially perpendicular to the bottom edge of back section 20. Strap 56 is securely attached to back section 20 not only at ends 56*a* and 56*b*, but also approximately halfway across its length at 56*c*. Webbing portion 64 passes under strap 56 between end 56*a* and midpoint 56*c*, loops under and around webbing portion 62, and passes back up under strap 56, between midpoint 56*c* and second end 56*b*.

In addition to buckle 70 which has been previously discussed, securely attached to second end 62*b* is a D-ring or lifting ring 72. When a rescue line is to be used with device 10, the line is hooked through the D-ring and the individual is pulled to safety. Obviously there is a great deal of weight and stress placed on the D-ring. Therefore, in the preferred embodiment, D-ring 72 is made of a strong material such as metal which will not crack, break, or otherwise become unsuitably deformed by the pressure on it when a rescue line is used with this device. D-ring 72 has a flat portion 72*a* and a curved portion 72*b*. Looped around flat portion 72*a* of D-ring 72 and securely attached is second end 62*b*. In order to provide that D-ring 72 (and buckle 70) remain in the desired location between right-front section 18 and left-front section 16, a fastening device is provided at second end 62*b* such that second end 62*b* can be releasably attached to strap 50. In particular, a snap 78 is provided with one-half located at end 62*b* near D-ring 72, and with the cooperatively mating other half located on strap 50 (see FIG. 3). Other appropriate fastening means could of course be used.

Figure 6:
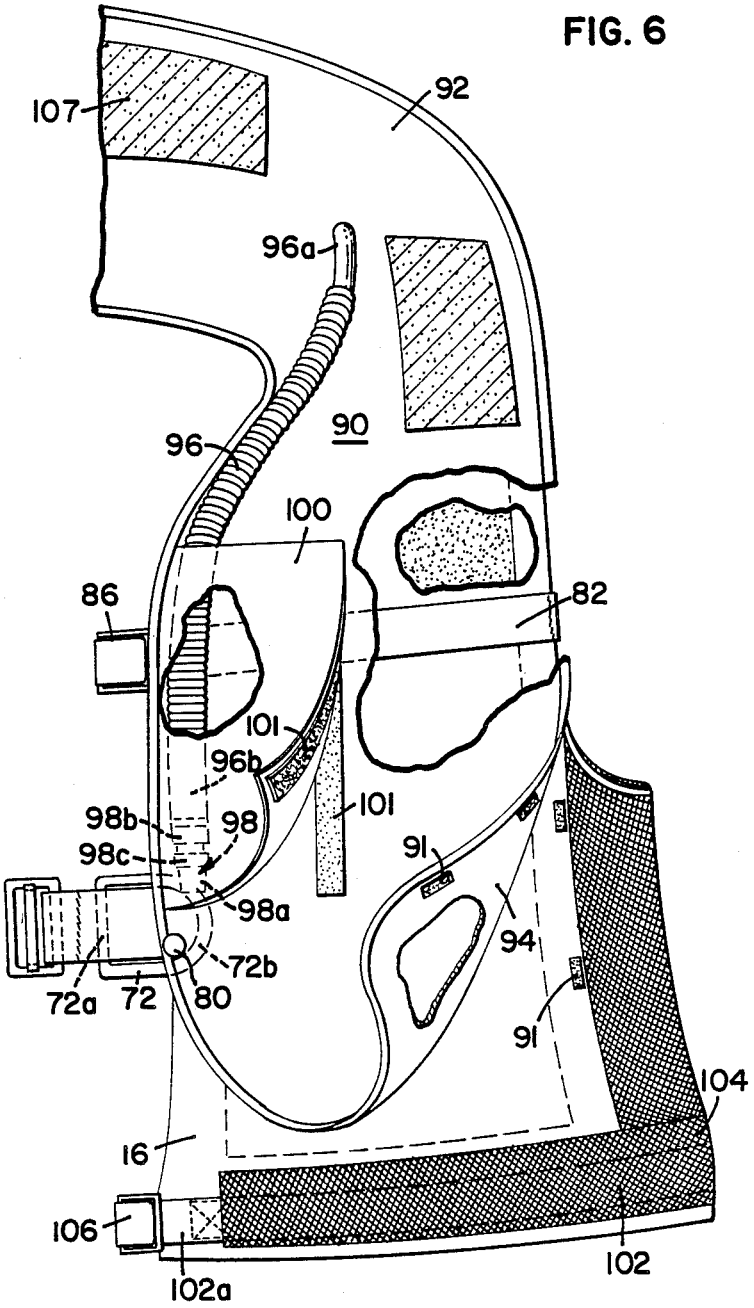
FIG. 6 is a front elevational view of the left-front side of the safety harness personal flotation device shown in FIG. 1, with the collar in the raised position.

Another snap 80 or other fastening device is provided as means for securing the D-ring out of the way when not in use with a rescue line. Half of this snap is located on outside surface 28 of body portion 12. The other cooperatively mating half is located on the inside surface of air bladder or chamber 90, later described in detail. As illustrated in FIG. 6, D-ring 72 can be flipped back toward left-front section 16 and placed between left-front section 16 and air chamber 90. Snap 80 can then be fastened inside the area defined by flat portion 72*a* and curved portion 72*b* of D-ring 72. This holds the D-ring out of the way when not in use, but allows easy accessibility to the D-ring by the simple unfastening of the snap and rotating of the D-ring away from left-front portion 16 and chamber 90, where it is accessible for attachment to a rescue line, as illustrated in FIG. 4. The area around snap 80, on the outer or outside surface 92 of chamber 90, can be marked to provide greater visibility of the exact location of the D-ring. Such marking can be accomplished through the use of fluorescent or other highly visible or contrasting coloring by means of tape, paint, dye, or the like.

In addition to the previously discussed use of strap 62 with buckle 70, a second means for securing the flotation device to the wearer comprises a strap 82 connected to and extending across left-front section 16, (see FIG. 6), and a corresponding strap 84, extending in the same way across right-front section 18. The straps are located across the upper chest area of the wearer. Cooperatively connected to at least one of these straps can be a means for fastening them together, to secure the flotation device to the wearer. In a preferred embodiment, this fastening means comprises a buckle 86 connected to the end of strap 82 and designed for engagement with strap 84. This buckle is of a well known type which securely holds the straps together, but which can be released for removal of the flotation device.

The buckle comprises a base, two substantially parallel side portions extending upwardly from the base, and a lever having a raised position and a lowered position. The lever is pivotally attached at one end between the side portions by means of protrusions extending from the sides of the lever into holes in the side portions. In the lowered position, substantially parallel to the base, the lever fits snugly between the side portions. To fasten the buckle, strap 84 is passed over the base between the side portions and under the lever until it extends beyond the buckle. The lever is placed in a lowered position and a ridge extending from the lever engages the straps, pressing it firmly into the base and holding it by compression. When it is desired to release strap 84, the lever is pivoted to the raised position, away from the base. Strap 84 is pulled back through the buckle and away from it. In the preferred embodiment, the free end of strap 84 is folded back on itself, for example, about an inch, and the folded portion is stitched close to the fold. This leaves the end-most portion of the strap doubled back but not secured, as a sort of flap extending from the end of strap 84. This flap catches in buckle 86 when the strap is pulled through the buckle to be released. An extra pulling effort is required to pull the flap through the buckle and totally release strap 84. This provides added safety in that even if the lever were accidentally jolted to the raised position, strap 84 would not easily work itself out of the buckle but would tend to remain caught by the flap; thus the device would tend to remain secured to the wearer.

Any other appropriate fastening means can of course be used to fasten straps 82 and 84 together. In the alternative, no fastening means at all may be used, but instead the straps can be of sufficient length to tie them together to secure the flotation device.

Additional securing means comprises a strap 102 having first end 102*a* and a second end 102*b*. Strap 102 is located along the bottom zone 12*b* of the body portion. When device 10 is worn, strap 102 encircles the wearer, and the first and second ends can be connected to each other, to aid in securing device 10 to the wearer.

Strap 102 can be carried along the bottom edge of body portion 12 by a casing 104. Strap 102 can be located within the casing along substantially the entire length of the bottom edge of body portion 12. The casing aids in preventing the strap from being caught by machinery or the like and thus provides increased safety. It can also aid in more evenly distributing any gathered fabric of the front or back sections, resulting from pulling the strap tight and connecting the ends. First and second ends 102*a* and 102*b* can be releasably connected to each other by means of a buckle 106 which can be secured to first end 102*a*. Buckle 106 can be substantially the same as buckle 86, previously discussed in detail. Second end 102*b* can be folded back on itself in the same manner and for the same purpose as the end of strap 84, as previously discussed. A loop (not shown) can be provided along the bottom edge of front section 14, for holding end 102*b* in place against the device when strap 102 is fastened. It is envisioned that fastening means other than buckle 106 can be used to secure first end 102*a* to second 102*b*, or no fastening means at all may be used other than simply tying the two ends together in the desired position.

The safety harness flotation device of the present invention can be a hybrid flotation device. A hybrid flotation device is one having inherent buoyancy, and the capability of increased buoyancy. Inherent buoyancy can arise from the incorporation of a buoyant mass such as a foamed material into the device. In the preferred embodiment of device 10, the inherent buoyancy arises particularly from buoyant member 30, and from any other buoyant mass located at back section 20 and/or front section 14.

The possibility of increased buoyancy can be provided by an air bladder or air chamber which is inflatable orally, by $CO_2$ cartridge, or the like. Device 10 comprises air chamber 90, which is in the general shape of a horseshoe. Air chamber 90 substantially overlaps front section 14 of body portion 12, and top zone 20*a* of back section 20 of the body portion. Air chamber 90 has an outer surface 92 and an inner surface 94. Inner surface 94 is the surface closest to buoyant body portion 12. Air chamber 90 can be made of any suitable flexible material which resists penetration by water or air, for example, a heat sealable nylon twill fabric having an air and water impermeable backing. Air chamber 90 will generally be formed of two layers of the suitable material, these layers being impermeably joined at the edges by heat sealing or other suitable means.

When not inflated, air chamber 90 can be held safely against body portion 12 by attaching means such as Velcro tabs 91. The attaching means prevents the chamber from flapping loosely which could present a safety hazard. For example, if not held in place, the loose chamber could become tangled in machinery and so on.

Means for inflating the air chamber is provided. This means comprises a hose-like tube 96 having a first end 96*a* and a second end 96*b*. Tube 96 is connected to the air chamber 90 such that an individual can blow air through the tube into the chamber 90. Hose-like tube 96 is cooperatively connected to the air chamber 90 through an opening (not shown) on outer surface 92 such that air can be forced through the hose-like tube between the layers of material which are sealed at the edges.

Hose-like tube 96 can be designed for inflation of the air chamber by oral means, $CO_2$ cartridge, or any other appropriate means. As shown in the Drawings, a preferred method of inflation is the oral method. A valve 98 is attached to second end 96*b* of hose-like tube 96. Valve 98 is well known in the art, having a mouthpiece 98*a*, a body 98*b*, and a locking nut 98*c*. Mouthpiece 98*a* is resiliently attached to body 98*b* such that with locking nut 98*c* screwed into a position away from the mouthpiece, the mouthpiece can be forced into body 98*b* but will spring back into its original position when pressure is no longer applied. When mouthpiece 98*a* is forced into body 98*b*, the valve is in an open position such that air or gas can enter or exit air chamber 90 through tube 96. When locking nut 98*c* is in the position shown in FIG. 6, locking nut 98*a* prevents mouthpiece 98*a* from being forced into body 98*b*. When the mouthpiece is not forced into body 98*b*, valve 98 is closed and no air can enter or escape the air chamber through tube 96.

Hose-like tube 96 is held in an easily accessible position against outer surface 92 of air chamber 90 by a loop (not shown) of elastic or other suitable material attached to outer surface 92. Covering this loop and a portion of hose-like tube 96 is a flap 100 of flexible material such as nylon twill. Flap 100 is secured to outer surface 92 along one of the flap's edges, allowing it to fold over tube 96 and be positioned substantially flat against outer surface 92. Flap 100 can also fold back away from outer surface 92, uncovering or exposing hose-like tube 96. The edge of flap 100 opposite the secured edge is releasably attached to outer surface 92. The attaching means can be Velcro strips 101, snaps, or any other suitable easily releasable attaching means. Flap 100 protects a length of hose-like tube 96 from exposure to sun, wind, dust, and the like, and also helps assure that the hose will not interfere with the wearer's activities or cause a safety problem by swinging loosely from the device.

When it is desired to inflate air chamber 90, flap 100 is pulled away from outer surface 92, releasing the Velcro strips and exposing hose-like tube 96. Second end 96*b* and valve 98 are brought to the inflator's mouth. Valve 98 is placed in the open position by digital manipulation of locking nut 98*c* followed by pressing mouthpiece 98*a* toward or into body 98*b*. Valve 98 can be easily manipulated into and maintained in the open position with one hand. The inflator then blows into valve 98 and the air flows into air chamber 90 through hose-like tube 96. When the inflator has blown in the desired amount of air, he releases mouthpiece 98*a* and valve 98 automatically returns to the closed position, preventing air from escaping from the air chamber through the tube. Locking nut 98*c* can then be screwed into place by digital manipulation to prevent the mouthpiece from accidentally being forced into the body and thus releasing air.

For ease in rescuing an individual from the water, segments or patches 107 of retroreflective material or tape are placed along outer surface 92 of air chamber 90. These patches will reflect light shining on them, making it easier for the rescuer to spot the individual in distress, whether during the daytime or at night. Other types of patches may be used, for example highly visible colored tapes such as orange or yellow, or patches having a radar-detectable surface so that the individual in peril can be located by radar even though there is no light. It is understood that any number of patches may be used. They can be applied with adhesives or any other means which will not jeopardize the impermeability of the air chamber.

Another feature of the safety harness personal flotation device is the crotch strap 108. Crotch strap 108 comprises a long portion 109 having a first end 109*a* and a second end 109*b*. First end 109*a* is securely attached to the bottom edge of body portion 12. Crotch strap 108 further comprises a means for releasably securing second end 109*b* to body portion 12. As shown in the Drawings, the securing means can comprise a short strap 110 having a first end attached to body portion 12, and a second end. Connected to the second end is a buckle 112 which cooperatively and releasably connects with second end 109*b* of long portion 109. Buckle 112 can be of the same type as buckles 106 and 86 previously discussed. Second end 109*b* can be folded back on itself in the same manner and for the same purpose as end 102*b* of strap 102, and as the end of strap 84 as previously discussed. When buckle 112 is fastened to second end 109*b* of long portion 109, crotch strap 108 is in the form of a loop extending from the bottom edge of body portion 12. When crotch strap 108 is used, it is passed between the legs of the wearer of device 10. Use of the crotch strap is optional. If device 10 is secured relatively tightly against the individual by way of the securing means such as straps 62, 82 and 84, and 102, then the wearer may prefer not to fasten the crotch strap. With device 10 tightly secured, device 10 will tend to remain on the wearer's upper body and will not ride up alongside his head should he fall into the water. However, since this device is designed to be worn by people who are working or engaging in recreational activities, and is primarily designed to be worn over clothing, the wearer may prefer to more loosely secure the device for greater comfort. In this case, if the individual should fall into the water, it is possible that the device will ride up on the individual around his head. To prevent this, the individual who wears the device loosely fastened against his body can fasten the crotch strap, which will typically prevent the device from riding up if the wearer actually does fall into the water.

Other modifications of the invention will be apparent to those skilled in the art in light of the foregoing description. Accordingly, the invention is not limited to the embodiments described herein or to the use of elements having the specific configurations and shapes as presented herein. All alternative modifications and variations of the present invention which follow in the spirit and broad scope of the appended claims are included.

I claim:

1. A safety harness personal flotation device to be worn on the body of an individual which comprises:

(a) a buoyant body portion comprising a front section having a top zone and a bottom zone and right-front and a left-front section, and a back section having a top zone and a bottom zone, the back section being cooperatively connected to the front section at both the top zones and the bottom zones, at least one of the front and back sections comprising a mass of buoyant material, the body portion also having an inside and an outside surface;

(b) a floating harness formed of webbing carried adjacent to the inside surface but not otherwise significantly permanently attached to the body portion;

(c) means for carrying the floating harness adjacent to the inside surface, comprising:

(i) a first strap, the first strap having first and second ends, the ends being attached to the inside surface of the body portion such that the first strap resides in a substantially horizontal alignment within the top zone of the right front section;

(ii) a second strap, the second strap having first and second ends, the ends being attached to the inside surface of the body portion such that the second strap resides in a substantially horizontal alignment near an intersection between the top zone of the right front section and the back section;

(iii) a third strap, the third strap having first and second ends, the ends being attached to the inside surface of the body portion such that the third strap resides in a substantially horizontal alignment near an intersection between the top zone and the bottom zone of the back section, the third strap having sufficient length to permit the webbing to pass twice between the third strap and the inside surface while the webbing resides in a substantially single plane;

(iv) a fourth strap, the fourth strap having first and second ends, the ends being attached to the inside surface of the body portion such that the fourth strap resides in a substantially horizontal alignment near an intersection between the top zone of the left front section and the back section; and (v) a fifth strap, the fifth strap having first and second ends, the ends being attached to the inside surface of the body portion such that the fifth strap resides in a substantially horizontal alignment with the top zone of the left front section, such that the webbing is threaded sequentially beneath the first strap, the second strap, twice through the third strap, the fourth strap and the fifth strap so as to allow horizontal and vertical movement of the webbing beneath the straps;

(d) a ring-like member connected to the floating harness and readily accessible for attachment to a rescue line, located between the right-front and the left-front section, wherein the device has sufficient integrity to support the dead weight of an individual wearing the device when the device is attached at the ring-like member to a rescue line and the individual is pulled into the air by the line, and wherein when the device is worn by an individual, the ring-like member is attached to a rescue line, and the rescue line pulls the individual into the air, stress caused by the dead weight of the individual will be borne substanitally by the floating harness rather than by the body portion.

2. The device of claim 1 further comprising an air chamber which can be inflated to provide increased bouyancy to the device.

3. A safety harness personal flotation device to be worn on the body of an individual wearer comprising:

(a) a buoyant body portion having a back section and a front section, the front section comprising a right-front section and a left-front section, both sections having shoulder areas and side areas, the back section being cooperatively connected to the front section at the shoulder and side areas, one of the sections comprising a mass of buoyant material, the body portion further having an inside and an outside surface and a top and bottom zone;

(b) a floating harness arrangement located on the inside surface, comprising:

(i) webbing which substantially encircles the torso of the individual wearer;

(ii) a first strap, the first strap having first and second ends, the ends being attached to the inside surface of the body portion such that the first strap resides in a substantially horizontal alignment within a top zone of the right front section;

(iii) a second strap, the second strap having first and second ends, the ends being attached to the inside surface of the body portion such that the second strap resides in a substantially horizontal alignment near an intersection between the top zone of the right front section and the back section;

(iv) a third strap, the third strap having first and second ends, the ends being attached to the inside surface of the body portion such that the third strap resides in a substantially horizontal alignment near an intersection between the top zone and the bottom zone of the back section, the third strap having sufficient length to permit the webbing to pass twice between the third strap and the inside surface while the webbing resides in a substantially single planes;

(v) a fourth strap, the fourth strap having first and second ends, the ends being attached to the inside surface of the body portion such that the fourth strap resides in a substantially horizontal alignment near an intersection between a top zone of the left front section and the back section; and (vi) a fifth strap, the fifth strap having first and second ends, the ends being attached to the inside surface of the body portion such that the fifth strap resides in a substantially horizontal alignment with the top zone of the left front section, such that the webbing is threaded sequentially beneath the first strap, the second strap, twice through the third strap, the fourth strap and the fifth strap so as to allow horizontal and vertical movement of the webbing beneath the straps;

(c) a ring-like member for attachment to a rescue line, the ring-like member being attached to the webbing and located proximate the front section of the device between the right-front section and the left-front section;

(d) means for securing the ring-like member to the body portion when not in use;

(e) an air chamber having an outer surface and capable of being inflated; and (f) means for inflating the air chamber, wherein the device has sufficient integrity to support the dead weight of an individual wearing the device when the device is attached at the ring-like member to a resuce line and the individual is pulled into the air by the line, and wherein when the device is worn by an individual, the ring-like member is attached to a rescue line, and the rescue line pulls the individual into the air, stress caused by the dead weight of the individual will be borne substantially by the floating harness rather than by the body portion.

4. The device of claim 3 further comprising a crotch strap designed to be worn between the legs of the individual wearer, the crotch strap having a first and second end, the first end being attached to the device, and the second end being releasably attached to the device.

5. The device of claim 3 further comprising retroreflective tape attached to said body portion.

6. The device of claim 5 wherein the retroreflective tape is located on the outer surface of the air chamber.

7. The device of claim 3 wherein the air chamber substantially overlaps the front section of the body portion and the top zone of back section of the body portion.

8. The device of claim 3 wherein the means for inflating the air chamber comprises a hose-like tube connected to the chamber such that an individual can blow air through the tube into the air chamber.

9. The device of claim 3 further comprising means for releasably securing the device to the torso of an individual.

10. The device of claim 9 wherein the releasably securing means comprises a securing strap attached to the left front portion and a securing strap attached to the right front portion, the securing straps being adjustably releasably connectable to each other, and a third securing strap having a first and second end, the third securing strap being carried along the bottom edge of the body portion by a casing and encircling the wearer, the first end being adjustably releasably connectable to the second end.

* * * * *